US009335042B2

(12) United States Patent
Beveridge et al.

(10) Patent No.: US 9,335,042 B2
(45) Date of Patent: May 10, 2016

(54) STEAM TEMPERATURE CONTROL USING DYNAMIC MATRIX CONTROL

(75) Inventors: Robert A. Beveridge, New Kensington, PA (US); Richard J. Whalen, Jr., Pittsburgh, PA (US)

(73) Assignee: EMERSON PROCESS MANAGEMENT POWER & WATER SOLUTIONS, INC., Pittsburgh, PA (US)

( * ) Notice: Subject to any disclaimer, the term of this patent is extended or adjusted under 35 U.S.C. 154(b) by 424 days.

(21) Appl. No.: 12/856,998

(22) Filed: Aug. 16, 2010

(65) Prior Publication Data

US 2012/0040298 A1 Feb. 16, 2012

(51) Int. Cl.
*F22B 37/00* (2006.01)
*F22G 5/12* (2006.01)

(52) U.S. Cl.
CPC ..... *F22G 5/12* (2013.01)

(58) Field of Classification Search
CPC ..... F22B 35/00; F22B 35/18; G06F 17/11; G06F 17/12
USPC ..... 122/6 R; 432/49, 36; 700/28–37, 44–45, 700/53, 209
See application file for complete search history.

(56) References Cited

U.S. PATENT DOCUMENTS

| | | | |
|---|---|---|---|
| 2,003,419 | A | 6/1935 | Artsay |
| 2,911,789 | A | 11/1959 | Baker |
| 3,016,711 | A | 1/1962 | Shakeshaft |
| 3,244,898 | A | 4/1966 | Hickox |
| 3,550,562 | A | 12/1970 | Strohmeyer, Jr. |
| 3,588,265 | A | 6/1971 | Berry |
| 3,837,167 | A | 9/1974 | Durrant et al. |
| 3,873,817 | A | 3/1975 | Liang |
| 3,875,384 | A | 4/1975 | Davis |
| 3,878,401 | A | 4/1975 | Ronnen |

(Continued)

FOREIGN PATENT DOCUMENTS

| | | | |
|---|---|---|---|
| GB | 1 486 570 | A | 9/1977 |
| GB | 2 454 357 | A | 5/2009 |
| GB | 2 482 954 | A | 2/2012 |

OTHER PUBLICATIONS

DMC*

(Continued)

*Primary Examiner* — Alissa Tompkins
*Assistant Examiner* — Nathaniel Herzfeld
(74) *Attorney, Agent, or Firm* — Marshall, Gerstein & Borun LLP

(57) ABSTRACT

A technique of controlling a steam generating boiler system includes using a rate of change of disturbance variables to control operation of a portion of the boiler system, and in particular, to control a temperature of output steam to a turbine. The technique uses a primary dynamic matrix control (DMC) block to control a field device that, at least in part, affects the output steam temperature. The primary DMC block uses the rate of change of a disturbance variable, a current output steam temperature, and an output steam temperature setpoint as inputs to generate a control signal. A derivative DMC block may be included to provide a boost signal based on the rate of change of the disturbance variable and/or other desired weighting. The boost signal is combined the control output of the primary DMC block to more quickly control the output steam temperature towards its desired level.

13 Claims, 6 Drawing Sheets

(56) References Cited

U.S. PATENT DOCUMENTS 3,879,616 A 4/1975 Baker et al.
3,898,441 A 8/1975 Davis et al.
3,911,286 A 10/1975 Uram
3,930,367 A 1/1976 Gasparoli
3,934,128 A 1/1976 Uram
3,937,934 A 2/1976 Pasemann
3,939,328 A 2/1976 Davis
3,948,043 A 4/1976 Martz
3,955,358 A 5/1976 Martz et al.
3,959,635 A 5/1976 Tanco
3,973,391 A 8/1976 Reed et al.
4,013,877 A 3/1977 Uram et al.
4,025,765 A 5/1977 Giras et al.
4,027,145 A * 5/1977 McDonald et al. ..... 700/287
4,028,884 A 6/1977 Martz et al.
4,029,255 A 6/1977 Heiser et al.
4,029,952 A 6/1977 Giras et al.
4,031,372 A 6/1977 Davis
4,035,624 A 7/1977 Lardi
4,037,088 A 7/1977 Davis et al.
4,047,005 A 9/1977 Heiser et al.
4,053,746 A 10/1977 Braytenbah et al.
4,053,747 A 10/1977 Davis
4,057,715 A 11/1977 Jones et al.
4,061,533 A 12/1977 Durrant
4,064,699 A 12/1977 Martz
4,086,773 A 5/1978 Kanegae et al.
4,090,065 A 5/1978 Braytenbah et al.
4,168,608 A 9/1979 Uram
4,184,324 A 1/1980 Kiscaden et al.
4,195,231 A 3/1980 Reed et al.
4,201,924 A 5/1980 Uram
4,205,380 A 5/1980 Braytenbah
4,220,869 A 9/1980 Uram
4,222,229 A 9/1980 Uram
4,227,093 A 10/1980 Uram et al.
4,236,220 A 11/1980 Kogami et al.
4,245,162 A 1/1981 Ronnen et al.
4,246,491 A 1/1981 Waldron et al.
4,258,424 A 3/1981 Giras et al.
4,267,458 A 5/1981 Uram et al.
4,270,055 A 5/1981 Ronnen et al.
4,333,310 A 6/1982 Uram
4,353,204 A 10/1982 Arakawa
4,427,896 A 1/1984 Waldron
4,445,180 A 4/1984 Davis et al.
4,471,620 A 9/1984 Binstock et al.
4,578,944 A 4/1986 Martens et al.
4,589,255 A * 5/1986 Martens et al. ..... 60/646
4,619,224 A * 10/1986 Takita et al. ..... 122/451 R
4,637,348 A 1/1987 Fukayama
4,644,479 A 2/1987 Kemper et al.
4,687,946 A 8/1987 Jones
4,888,953 A 12/1989 Fukayama et al.
4,975,238 A 12/1990 Regan et al.
5,091,844 A 2/1992 Waltz
5,237,816 A 8/1993 Duffy et al.
5,268,835 A 12/1993 Miyagaki et al.
5,413,175 A 5/1995 Edmunds
5,453,925 A 9/1995 Wojsznis et al.
5,485,754 A 1/1996 Harpster
5,517,424 A * 5/1996 Marcelle et al. ..... 700/287
5,568,378 A 10/1996 Wojsznis
5,594,858 A 1/1997 Blevins
5,646,513 A 7/1997 Riggio, Jr.
5,752,411 A 5/1998 Harpster
5,841,652 A * 11/1998 Sanchez ..... 700/44
5,943,865 A 8/1999 Cohen
6,109,019 A 8/2000 Sugishita
6,223,520 B1 5/2001 Kita
6,445,962 B1 9/2002 Blevins et al.
6,445,963 B1 9/2002 Blevins et al.
6,453,308 B1 * 9/2002 Zhao et al. ..... 706/21
6,459,939 B1 10/2002 Hugo
6,501,998 B1 12/2002 Pfeiffer
6,510,351 B1 1/2003 Blevins et al.
6,577,908 B1 6/2003 Wojsznis et al.
6,609,361 B2 8/2003 Vugdelija
6,681,155 B1 1/2004 Fujita et al.
6,721,609 B1 4/2004 Wojsznis et al.
6,847,954 B1 1/2005 Wojsznis et al.
6,901,300 B2 5/2005 Blevins et al.
6,970,750 B2 11/2005 Wojsznis et al.
7,043,311 B2 5/2006 Nixon et al.
7,110,835 B2 9/2006 Blevins et al.
7,113,834 B2 9/2006 Wojsznis et al.
7,117,052 B2 10/2006 Lucas et al.
7,242,989 B2 7/2007 Blevins et al.
7,272,454 B2 9/2007 Wojsznis et al.
7,317,953 B2 1/2008 Wojsznis et al.
7,337,022 B2 2/2008 Wojsznis et al.
7,346,472 B1 3/2008 Moskowitz et al.
7,376,472 B2 5/2008 Wojsznis et al.
7,421,354 B2 * 9/2008 Brunell ..... 702/69
7,451,004 B2 11/2008 Thiele et al.
7,496,041 B2 2/2009 Blevins et al.
7,526,347 B2 4/2009 Lucas et al.
7,551,969 B2 6/2009 Wojsznis et al.
7,587,252 B2 9/2009 Blevins et al.
7,596,198 B1 * 9/2009 Srinivasan ..... 376/247
7,620,460 B2 11/2009 Blevins et al.
7,647,126 B2 1/2010 Blevins et al.
7,702,409 B2 4/2010 Lucas et al.
7,729,789 B2 6/2010 Blevins et al.
7,729,792 B2 6/2010 Lucas et al.
7,738,975 B2 6/2010 Denison et al.
7,826,908 B2 11/2010 Cheng et al.
7,840,287 B2 11/2010 Wojsznis et al.
7,856,281 B2 12/2010 Thiele et al.
7,877,154 B2 1/2011 Blevins et al.
7,922,155 B2 4/2011 Havlena
7,930,045 B2 4/2011 Cheng
7,945,339 B2 5/2011 Blevins et al.
7,971,052 B2 6/2011 Lucas et al.
8,046,096 B2 10/2011 Denison et al.
8,055,358 B2 11/2011 Blevins et al.
8,060,834 B2 11/2011 Lucas et al.
8,127,241 B2 2/2012 Blevins et al.
8,135,481 B2 3/2012 Blevins et al.
8,185,217 B2 5/2012 Thiele
8,200,346 B2 6/2012 Thiele
8,280,533 B2 10/2012 Wojsznis et al.
8,326,666 B2 12/2012 Caldwell et al.
8,433,450 B2 4/2013 Francino et al.
8,473,087 B2 6/2013 Lucas et al.
8,509,926 B2 8/2013 Blevins et al.
2001/0021900 A1 * 9/2001 Kassmann ..... 703/2
2002/0071975 A1 6/2002 Shimazu
2002/0120352 A1 8/2002 Stothert et al.
2003/0028265 A1 * 2/2003 Martin ..... 700/31
2003/0046939 A1 3/2003 Hyakutake et al.
2003/0120359 A1 6/2003 O'Leary et al.
2004/0050072 A1 3/2004 Palfy et al.
2004/0050076 A1 3/2004 Palfy et al.
2004/0244729 A1 * 12/2004 Lefebvre et al. ..... 122/379
2005/0096872 A1 5/2005 Blevins et al.
2005/0136303 A1 6/2005 Kobayshi et al.
2006/0052902 A1 3/2006 Lefebvre et al.
2006/0191896 A1 8/2006 Cheng et al.
2006/0224534 A1 10/2006 Hartman et al.
2006/0283406 A1 12/2006 Francino et al.
2007/0042768 A1 2/2007 Gazeley
2007/0055392 A1 3/2007 D'Amato et al.
2007/0129917 A1 6/2007 Blevins et al.
2007/0151243 A1 7/2007 Stewart
2007/0174225 A1 7/2007 Blevins et al.
2007/0198104 A1 8/2007 Sayyarrodsari et al.
2007/0208549 A1 9/2007 Blevins et al.
2008/0016647 A1 * 1/2008 Francino et al. ..... 15/318.1
2008/0029261 A1 * 2/2008 Kephart et al. ..... 165/293
2008/0077257 A1 3/2008 Peterson et al.
2008/0082180 A1 4/2008 Blevins et al.
2008/0125881 A1 5/2008 Grott et al.
2008/0141953 A1 6/2008 Hirayama et al.

(56) References Cited

U.S. PATENT DOCUMENTS

| | | | |
|---|---|---|---|
| 2008/0148713 | A1 | 6/2008 | White et al. |
| 2008/0244975 | A1 | 10/2008 | Johnston |
| 2008/0288198 | A1 | 11/2008 | Francino et al. |
| 2008/0302102 | A1 | 12/2008 | Cheng et al. |
| 2009/0012653 | A1 | 1/2009 | Cheng et al. |
| 2009/0016609 | A1 | 1/2009 | Zakrzewski et al. |
| 2009/0040367 | A1 | 2/2009 | Zakrzewski et al. |
| 2009/0056036 | A1 | 3/2009 | Herkle et al. |
| 2009/0063113 | A1 | 3/2009 | Francino et al. |
| 2009/0089247 | A1 | 4/2009 | Blevins et al. |
| 2009/0118873 | A1 | 5/2009 | Cheng et al. |
| 2010/0062381 | A1 | 3/2010 | Gross et al. |
| 2010/0077970 | A1 | 4/2010 | Kumar et al. |
| 2010/0162700 | A1 | 7/2010 | Birnbaum et al. |
| 2010/0236241 | A1 | 9/2010 | Kumar et al. |
| 2010/0241249 | A1 | 9/2010 | Jia et al. |
| 2010/0318934 | A1 | 12/2010 | Blevins et al. |
| 2011/0040390 | A1 | 2/2011 | Blevins et al. |
| 2011/0066298 | A1 | 3/2011 | Francino et al. |
| 2011/0131017 | A1 | 6/2011 | Cheng et al. |
| 2011/0131455 | A1 | 6/2011 | Law et al. |
| 2011/0218782 | A1 | 9/2011 | Coughran et al. |
| 2011/0224808 | A1 | 9/2011 | Lucas et al. |
| 2011/0230980 | A1 | 9/2011 | Hammack et al. |
| 2011/0245937 | A1 | 10/2011 | Rawson et al. |
| 2011/0288660 | A1 | 11/2011 | Wojsznis et al. |
| 2011/0288786 | A1 | 11/2011 | Blevins et al. |
| 2011/0288837 | A1 | 11/2011 | Blevins et al. |
| 2012/0010757 | A1 | 1/2012 | Francino et al. |
| 2012/0010758 | A1 | 1/2012 | Francino et al. |
| 2012/0030852 | A1* | 2/2012 | Anscher ..... 2/102 |
| 2012/0040299 | A1* | 2/2012 | Beveridge et al. ..... 432/13 |
| 2013/0085795 | A1 | 4/2013 | Caldwell et al. |
| 2013/0110298 | A1 | 5/2013 | Beveridge |

OTHER PUBLICATIONS

Qin, S. Joe and Thomas A. Badgwell, "An Overview of Industrial Model Predictive Control Technology," *AIChE Conference*, 1996.

Search Report for Application No. GB1113709.8, dated Nov. 16, 2011.

Search Report for Application No. GB1113708.0, dated Nov. 16, 2011.

Search Report for Application No. GB1112940.0, dated Nov. 9, 2011.

Search Report for Application No. GB1219482.5, dated Feb. 5, 2013.

* cited by examiner

STEAM TEMPERATURE CONTROL USING DYNAMIC MATRIX CONTROL

TECHNICAL FIELD

This patent relates generally to the control of boiler systems and in one particular instance to the control and optimization of steam generating boiler systems using dynamic matrix control.

BACKGROUND

A variety of industrial as well as non-industrial applications use fuel burning boilers which typically operate to convert chemical energy into thermal energy by burning one of various types of fuels, such as coal, gas, oil, waste material, etc. An exemplary use of fuel burning boilers is in thermal power generators, wherein fuel burning boilers generate steam from water traveling through a number of pipes and tubes within the boiler, and the generated steam is then used to operate one or more steam turbines to generate electricity. The output of a thermal power generator is a function of the amount of heat generated in a boiler, wherein the amount of heat is directly determined by the amount of fuel consumed (e.g., burned) per hour, for example.

In many cases, power generating systems include a boiler which has a furnace that burns or otherwise uses fuel to generate heat which, in turn, is transferred to water flowing through pipes or tubes within various sections of the boiler. A typical steam generating system includes a boiler having a superheater section (having one or more sub-sections) in which steam is produced and is then provided to and used within a first, typically high pressure, steam turbine. To increase the efficiency of the system, the steam exiting this first steam turbine may then be reheated in a reheater section of the boiler, which may include one or more subsections, and the reheated steam is then provided to a second, typically lower pressure steam turbine. While the efficiency of a thermal-based power generator is heavily dependent upon the heat transfer efficiency of the particular furnace/boiler combination used to burn the fuel and transfer the heat to the water flowing within the various sections of the boiler, this efficiency is also dependent on the control technique used to control the temperature of the steam in the various sections of the boiler, such as in the superheater section of the boiler and in the reheater section of the boiler.

However, as will be understood, the steam turbines of a power plant are typically run at different operating levels at different times to produce different amounts of electricity based on energy or load demands. For most power plants using steam boilers, the desired steam temperature setpoints at final superheater and reheater outlets of the boilers are kept constant, and it is necessary to maintain steam temperature close to the setpoints (e.g., within a narrow range) at all load levels. In particular, in the operation of utility (e.g., power generation) boilers, control of steam temperature is critical as it is important that the temperature of steam exiting from a boiler and entering a steam turbine is at an optimally desired temperature. If the steam temperature is too high, the steam may cause damage to the blades of the steam turbine for various metallurgical reasons. On the other hand, if the steam temperature is too low, the steam may contain water particles, which in turn may cause damage to components of the steam turbine over prolonged operation of the steam turbine as well as decrease efficiency of the operation of the turbine. Moreover, variations in steam temperature also cause metal material fatigue, which is a leading cause of tube leaks.

Typically, each section (i.e., the superheater section and the reheater section) of the boiler contains cascaded heat exchanger sections wherein the steam exiting from one heat exchanger section enters the following heat exchanger section with the temperature of the steam increasing at each heat exchanger section until, ideally, the steam is output to the turbine at the desired steam temperature. In such an arrangement, steam temperature is controlled primarily by controlling the temperature of the water at the output of the first stage of the boiler which is primarily achieved by changing the fuel air mixture provided to the furnace or by changing the ratio of firing rate to input feedwater provided to the furnace/boiler combination. In once-through boiler systems, in which no drum is used, the firing rate to feedwater ratio input to the system may be used primarily to regulate the steam temperature at the input of the turbines.

While changing the fuel/air ratio and the firing rate to feedwater ratio provided to the furnace/boiler combination operates well to achieve desired control of the steam temperature over time, it is difficult to control short term fluctuations in steam temperature at the various sections of the boiler using only fuel/air mixture control and firing rate to feedwater ratio control. Instead, to perform short term (and secondary) control of steam temperature, saturated water is sprayed into the steam at a point before the final heat exchanger section located immediately upstream of the turbine. This secondary steam temperature control operation typically occurs before the final superheater section of the boiler and/or before the final reheater section of the boiler. To effect this operation, temperature sensors are provided along the steam flow path and between the heat exchanger sections to measure the steam temperature at critical points along the flow path, and the measured temperatures are used to regulate the amount of saturated water sprayed into the steam for steam temperature control purposes.

In many circumstances, it is necessary to rely heavily on the spray technique to control the steam temperature as precisely as needed to satisfy the turbine temperature constraints described above. In one example, once-through boiler systems, which provide a continuous flow of water (steam) through a set of pipes within the boiler and do not use a drum to, in effect, average out the temperature of the steam or water exiting the first boiler section, may experience greater fluctuations in steam temperature and thus typically require heavier use of the spray sections to control the steam temperature at the inputs to the turbines. In these systems, the firing rate to feedwater ratio control is typically used, along with superheater spray flow, to regulate the furnace/boiler system. In these and other boiler systems, a distributed control system (DCS) uses cascaded PID (Proportional Integral Derivative) controllers to control both the fuel/air mixture provided to the furnace as well as the amount of spraying performed upstream of the turbines.

However, cascaded PID controllers typically respond in a reactionary manner to a difference or error between a setpoint and an actual value or level of a dependent process variable to be controlled, such as a temperature of steam to be delivered to the turbine. That is, the control response occurs after the dependent process variable has already drifted from its set point. For example, spray valves that are upstream of a turbine are controlled to readjust their spray flow only after the temperature of the steam delivered to the turbine has drifted from its desired target. Needless to say, this reactionary control response coupled with changing boiler operating conditions can result in large temperature swings that cause stress on the boiler system and shorten the lives of tubes, spray control valves, and other components of the system.

SUMMARY

Embodiments of systems, methods, and controllers including a feed forward technique of controlling a steam generating system include using dynamic matrix control to control at least a portion of the steam generating system, such as a temperature of output steam to a turbine. As used herein, the term "output steam" refers to the steam delivered from the steam generating system immediately into a turbine. An "output steam temperature," as used herein, is a temperature of the output steam that is exiting the steam generating system and entering into the turbine.

The feed forward technique of controlling a steam generating system may include a dynamic matrix control block that receives, as its inputs, signals corresponding to a rate of change of a disturbance variable; an actual value, level or measurement of the portion of the steam generating system that is to be controlled (e.g., the actual output steam temperature); and a setpoint of the portion of the steam generating system that is to be controlled (e.g., the output steam temperature setpoint). The feed forward control technique does not, however, require receiving any signal that corresponds to an intermediate measurement, such as a temperature of the steam at a location in the steam generating system upstream of the output steam. Based on the inputs, the dynamic matrix control block generates a control signal for a field device, and the field device is controlled based on the control signal to influence the at least a portion of the steam generating system towards its desired setpoint. Thus, the feed forward technique controls the field device while a change or an error is occurring (rather than after the change or the error has occurred), and provides advanced correction while eliminating radical swings, overshoots, and undershoots. Accordingly, life spans of tubes, valves, and other internal components of the steam generating system are prolonged as the feed forward technique minimizes stress due to swings of temperature and other variables in the system. "Hunting" for valve position as experienced with PID control may be eliminated, and less tuning is required.

The feed forward control technique may also or instead use a second dynamic matrix control block which performs control based on the rate of change of a disturbance variable, referred to herein as a derivative dynamic matrix control block. A derivative dynamic matrix control block generates a boost signal based on the rate of change of the disturbance variable, and the boost signal is combined with the control signal generated by the first or primary dynamic matrix control block to be delivered to control the field device. Thus, as a rate of change of a disturbance variable increases, the boost contributed by the derivative matrix control block to the control technique allows the portion of the steam generating system that is to be controlled to be controlled towards its setpoint at an even quicker rate than by using only the primary dynamic matrix control block.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention as describing every possible embodiment would be impractical, if not impossible. Numerous alternative embodiments could be implemented, using either current technology or technology developed after the filing date of this patent, which would still fall within the scope of the claims defining the invention.

Figure 1:
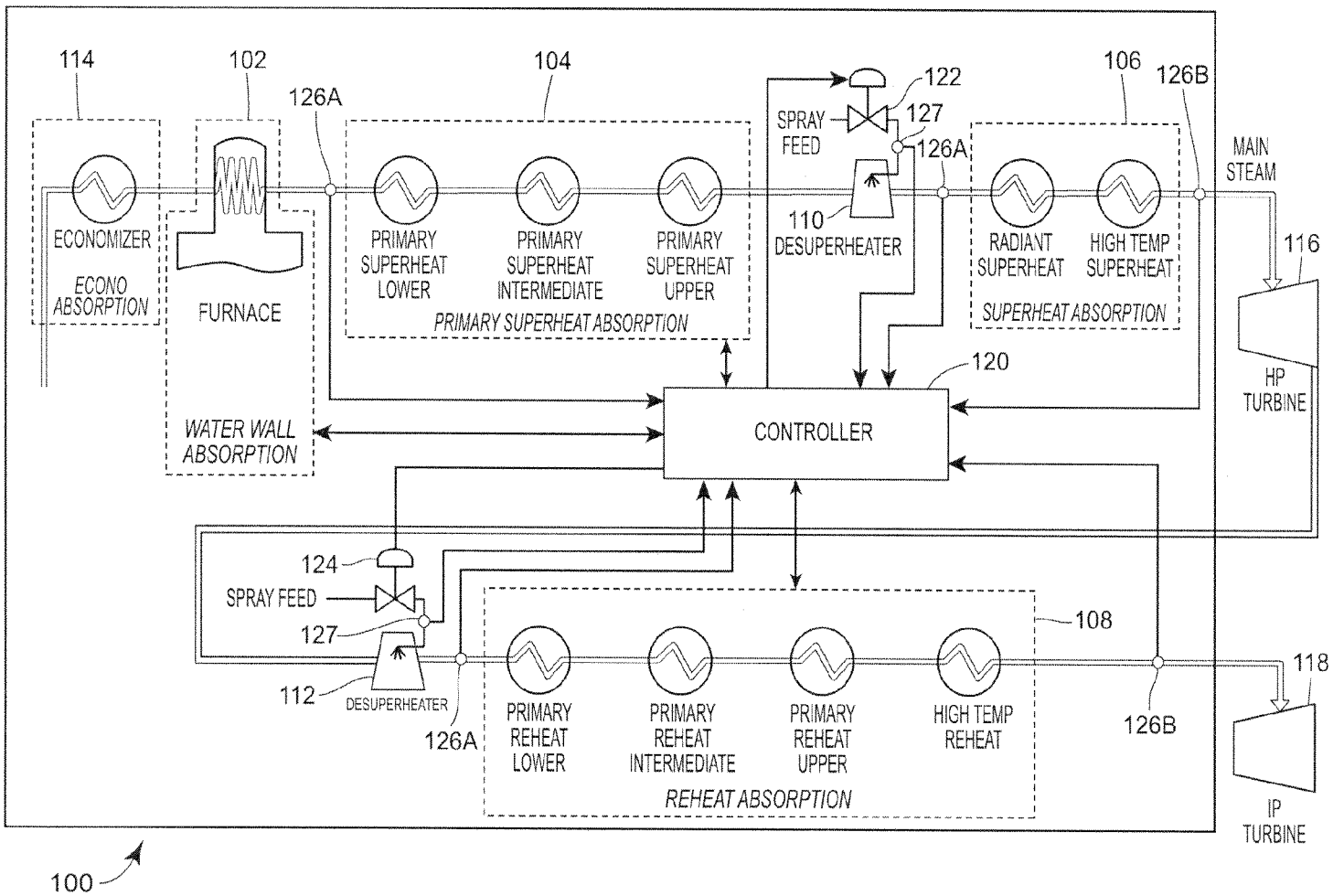
FIG. 1 illustrates a block diagram of a typical boiler steam cycle for a typical set of steam powered turbines, the boiler steam cycle having a superheater section and a reheater section.

FIG. 1 illustrates a block diagram of a once-through boiler steam cycle for a typical boiler 100 that may be used, for example, in a thermal power plant. The boiler 100 may include various sections through which steam or water flows in various forms such as superheated steam, reheated steam, etc. While the boiler 100 illustrated in FIG. 1 has various boiler sections situated horizontally, in an actual implementation, one or more of these sections may be positioned vertically with respect to one another, especially because flue gases heating the steam in various different boiler sections, such as a water wall absorption section, rise vertically (or, spiral vertically).

In any event, as illustrated in FIG. 1, the boiler 100 includes a furnace and a primary water wall absorption section 102, a primary superheater absorption section 104, a superheater absorption section 106 and a reheater section 108. Additionally, the boiler 100 may include one or more desuperheaters or sprayer sections 110 and 112 and an economizer section 114. During operation, the main steam generated by the boiler 100 and output by the superheater section 106 is used to drive a high pressure (HP) turbine 116 and the hot reheated steam coming from the reheater section 108 is used to drive an intermediate pressure (IP) turbine 118. Typically, the boiler 100 may also be used to drive a low pressure (LP) turbine, which is not shown in FIG. 1.

The water wall absorption section 102, which is primarily responsible for generating steam, includes a number of pipes through which water or steam from the economizer section 114 is heated in the furnace. Of course, feedwater coming into the water wall absorption section 102 may be pumped through the economizer section 114 and this water absorbs a large amount of heat when in the water wall absorption section 102. The steam or water provided at output of the water wall absorption section 102 is fed to the primary superheater absorption section 104, and then to the superheater absorption section 106, which together raise the steam temperature to very high levels. The main steam output from the superheater absorption section 106 drives the high pressure turbine 116 to generate electricity.

Once the main steam drives the high pressure turbine 116, the steam is routed to the reheater absorption section 108, and the hot reheated steam output from the reheater absorption section 108 is used to drive the intermediate pressure turbine 118. The spray sections 110 and 112 may be used to control the final steam temperature at the inputs of the turbines 116 and 118 to be at desired setpoints. Finally, the steam from the intermediate pressure turbine 118 may be fed through a low pressure turbine system (not shown here), to a steam condenser (not shown here), where the steam is condensed to a liquid form, and the cycle begins again with various boiler feed pumps pumping the feedwater through a cascade of feedwater heater trains and then an economizer for the next cycle. The economizer section 114 is located in the flow of hot exhaust gases exiting from the boiler and uses the hot gases to transfer additional heat to the feedwater before the feedwater enters the water wall absorption section 102.

As illustrated in FIG. 1, a controller or controller unit 120 is communicatively coupled to the furnace within the water wall section 102 and to valves 122 and 124 which control the amount of water provided to sprayers in the spray sections 110 and 112. The controller 120 is also coupled to various sensors, including intermediate temperature sensors 126A located at the outputs of the water wall section 102, the desuperheater section 110, and the desuperheater section 112; output temperature sensors 126B located at the second superheater section 106 and the reheater section 108; and flow sensors 127 at the outputs of the valves 122 and 124. The controller 120 also receives other inputs including the firing rate, a load signal (typically referred to as a feed forward signal) which is indicative of and/or a derivative of an actual or desired load of the power plant, as well as signals indicative of settings or features of the boiler including, for example, damper settings, burner tilt positions, etc. The controller 120 may generate and send other control signals to the various boiler and furnace sections of the system and may receive other measurements, such as valve positions, measured spray flows, other temperature measurements, etc. While not specifically illustrated as such in FIG. 1, the controller or controller unit 120 could include separate sections, routines and/or control devices for controlling the superheater and the reheater sections of the boiler system.

Figure 2:
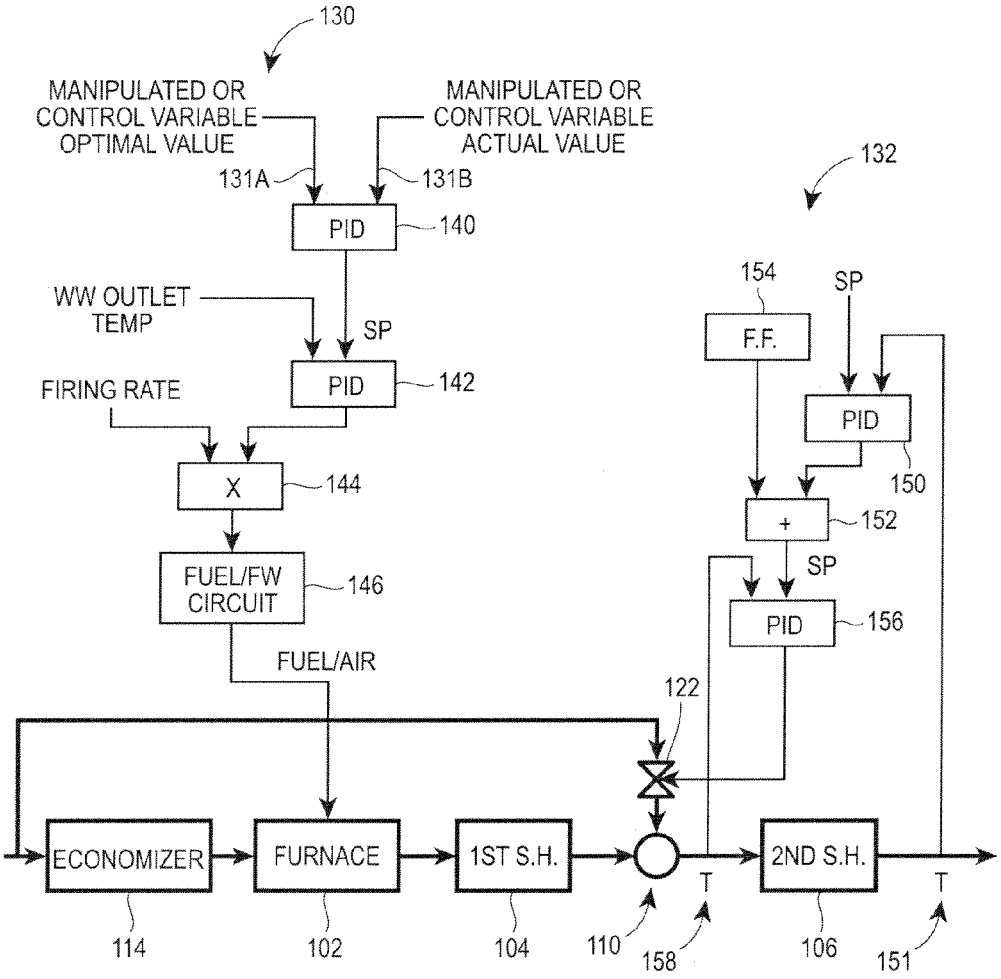
FIG. 2 (PRIOR ART)
FIG. 2 illustrates a schematic diagram of a prior art manner of controlling a superheater section of a boiler steam cycle for a steam powered turbine, such as that of FIG.

FIG. 2 is a schematic diagram 128 showing the various sections of the boiler system 100 of FIG. 1 and illustrating a typical manner in which control is currently performed in boilers in the prior art. In particular, the diagram 128 illustrates the economizer 114, the primary furnace or water wall section 102, the first superheater section 104, the second superheater section 106 and the spray section 110 of FIG. 1. In this case, the spray water provided to the superheater spray section 110 is tapped from the feed line into the economizer 114. FIG. 2 also illustrates two PID-based control loops 130 and 132 which may be implemented by the controller 120 of FIG. 1 or by other DCS controllers to control the fuel and feedwater operation of the furnace 102 to affect the output steam temperature 151 delivered by the boiler system to the turbine.

In particular, the control loop 130 includes a first control block 140, illustrated in the form of a proportional-integral-derivative (PID) control block, which uses, as a primary input, a setpoint 131A in the form of a factor or signal corresponding to a desired or optimal value of a control variable or a manipulated variable 131A used to control or associated with a section of the boiler system 100. The desired value 131A may correspond to, for example, a desired superheater spray setpoint or an optimal burner tilt position. In other cases, the desired or optimal value 131A may correspond to a damper position of a damper within the boiler system 100, a position of a spray valve, an amount of spray, some other control, manipulated or disturbance variable or combination thereof that is used to control or is associated with the section of the boiler system 100. Generally, the setpoint 131A may correspond to a control variable or a manipulated variable of the boiler system 100, and may be typically set by a user or an operator.

The control block 140 compares the setpoint 131A to a measure of the actual control or manipulated variable 131B currently being used to produce a desired output value. For clarity of discussion, FIG. 2 illustrates an embodiment where the setpoint 131A at the control block 140 corresponds to a desired superheater spray. The control block 140 compares the superheater spray setpoint to a measure of the actual superheater spray amount (e.g., superheater spray flow) currently being used to produce a desired water wall outlet temperature setpoint. The water wall output temperature setpoint is indicative of the desired water wall outlet temperature needed to control the temperature at the output of the second superheater 106 (reference 151) to be at the desired turbine input temperature, using the amount of spray flow specified by the desired superheater spray setpoint. This water wall outlet temperature setpoint is provided to a second control block 142 (also illustrated as a PID control block), which compares the water wall outlet temperature setpoint to a signal indicative of the measured water wall steam temperature and operates to produce a feed control signal. The feed control signal is then scaled in a multiplier block 144, for example, based on the firing rate (which is indicative of or based on the power demand). The output of the multiplier block 144 is provided as a control input to a fuel/feedwater circuit 146, which operates to control the firing rate to feedwater ratio of the furnace/boiler combination or to control the fuel to air mixture provided to the primary furnace section 102.

The operation of the superheater spray section 110 is controlled by the control loop 132. The control loop 132 includes a control block 150 (illustrated in the form of a PID control block) which compares a temperature setpoint for the temperature of the steam at the input to the turbine 116 (typically fixed or tightly set based on operational characteristics of the turbine 116) to a measurement of the actual temperature of the steam at the input of the turbine 116 (reference 151) to produce an output control signal based on the difference between the two. The output of the control block 150 is provided to a summer block 152 which adds the control signal from the control block 150 to a feed forward signal which is developed by a block 154 as, for example, a derivative of a load signal corresponding to an actual or desired load generated by the turbine 116. The output of the summer block 152 is then provided as a setpoint to a further control block 156 (again illustrated as a PID control block), which setpoint indicates the desired temperature at the input to the second superheater section 106 (reference 158). The control block 156 compares the setpoint from the block 152 to an intermediate measurement of the steam temperature 158 at the output of the superheater spray section 110, and, based on the difference between the two, produces a control signal to control the valve 122 which controls the amount of the spray provided in the superheater spray section 110. As used herein, an "intermediate" measurement or value of a control variable or a manipulated variable is determined at a location that is upstream of a location at which a dependent process variable that is desired to be controlled is measured. For example, as illustrated in FIG. 2, the "intermediate" steam temperature 158 is determined at a location that is upstream of the location at which the output steam temperature 151 is measured (e.g., intermediate steam temperature 158 is determined at a location that is further away from the turbine 116 than output steam temperature 151).

Thus, as seen from the PID-based control loops 130 and 132 of FIG. 2, the operation of the furnace 102 is directly controlled as a function of the desired superheater spray 131A, the intermediate temperature measurement 158, and the output steam temperature 151. In particular, the control loop 132 operates to keep the temperature of the steam at the input of the turbine 116 (reference 151) at a setpoint by controlling the operation of the superheater spray section 110, and the control loop 130 controls the operation of the fuel provided to and burned within the furnace 102 to keep the superheater spray at a predetermined setpoint (to thereby attempt to keep the superheater spray operation or spray amount at an "optimum" level).

Of course, while the embodiment discussed uses the superheater spray flow amount as an input to the control loop 130, one or more other control related signals or factors could be used as well or in other circumstances as an input to the control loop 130 for developing one or more output control signals to control the operation of the boiler/furnace, and thereby provide steam temperature control. For example, the control block 140 may compare the actual burner tilt positions with an optimal burner tilt position, which may come from off-line unit characterization (especially for boiler systems manufactured by Combustion Engineering) or a separate on-line optimization program or other source. In another example with a different boiler design configuration, if flue gas by-pass damper(s) are used for primary reheater steam temperature control, then the signals indicative of the desired (or optimal) and actual burner tilt positions in the control loop 130 may be replaced or supplemented with signals indicative of or related to the desired (or optimal) and actual damper positions.

Additionally, while the control loop 130 of FIG. 2 is illustrated as producing a control signal for controlling the fuel/air mixture of the fuel provided to the furnace 102, the control loop 130 could produce other types or kinds of control signals to control the operation of the furnace such as the fuel to feedwater ratio used to provide fuel and feedwater to the furnace/boiler combination, the amount or quantity or type of fuel used in or provided to the furnace, etc. Still further, the control block 140 may use some disturbance variable as its input even if that variable itself is not used to directly control the dependent variable (in the above embodiment, the desired output steam temperature 151).

Furthermore, as seen from the control loops 130 and 132 of FIG. 2, the control of the operation of the furnace in both control loops 130 and 132 is reactionary. That is, the control loops 130 and 132 (or portions thereof) react to initiate a change only after a difference between a setpoint and an actual value is detected. For example, only after the control block 150 detects a difference between the output steam temperature 151 and a desired setpoint does the control block 150 produce a control signal to the summer 152, and only after the control block 140 detects a difference between a desired and an actual value of a disturbance or manipulated variable does the control block 140 produce a control signal corresponding to a water wall outlet temperature setpoint to the control block 142. This reactionary control response can result in large output swings that cause stress on the boiler system, thereby shortening the life of tubes, spray control valves, and other components of the system, and in particular when the reactionary control is coupled with changing boiler operating conditions.

Figure 3:
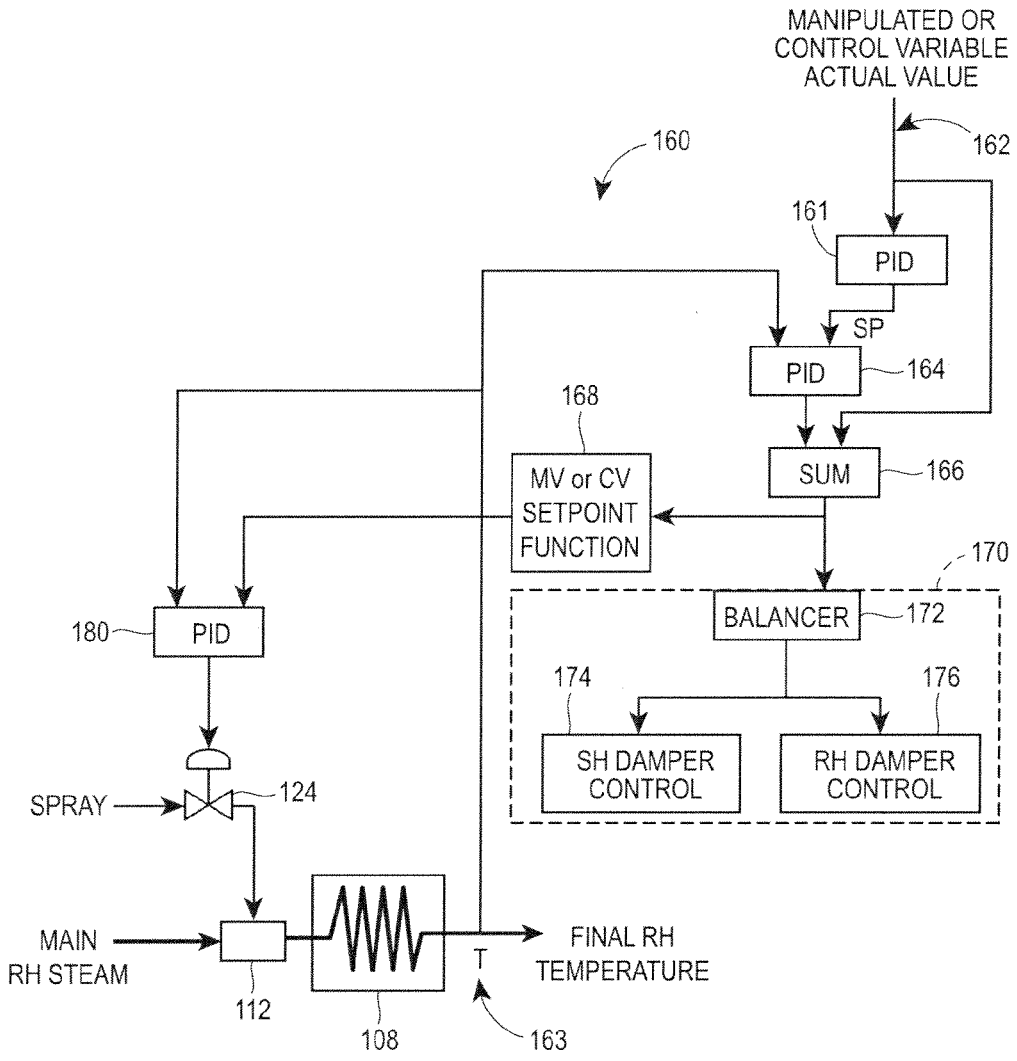
FIG. 3 (PRIOR ART)
FIG. 3 illustrates a schematic diagram of a prior art manner of controlling a reheater section of a boiler steam cycle for a steam powered turbine system, such as that of FIG. 1.

FIG. 3 illustrates a typical (prior art) control loop 160 used in a reheater section 108 of a steam turbine power generation system, which may be implemented by, for example, the controller or controller unit 120 of FIG. 1. Here, a control block 161 may operate on a signal corresponding to an actual value of a control variable or a manipulated variable 162 used to control or associated with the boiler system 100. For clarity of discussion, FIG. 3 illustrates an embodiment of the control loop 160 in which the input 162 corresponds to steam flow (which is typically determined by load demands). The control block 161 produces a temperature setpoint for the temperature of the steam being input to the turbine 118 as a function of the steam flow. A control block 164 (illustrated as a PID control block) compares this temperature setpoint to a measurement of the actual steam temperature 163 at the output of the reheater section 108 to produce a control signal as a result of the difference between these two temperatures. A block 166 then sums this control signal with a measure of the steam flow and the output of the block 166 is provided to a spray setpoint unit or block 168 as well as to a balancer unit 170.

The balancer unit 170 includes a balancer 172 which provides control signals to a superheater damper control unit 174 as well as to a reheater damper control unit 176 which operate to control the flue gas dampers in the various superheater and the reheater sections of the boiler. As will be understood, the flue gas damper control units 174 and 176 alter or change the damper settings to control the amount of flue gas from the furnace which is diverted to each of the superheater and reheater sections of the boilers. Thus, the control units 174 and 176 thereby control or balance the amount of energy provided to each of the superheater and reheater sections of the boiler. As a result, the balancer unit 170 is the primary control provided on the reheater section 108 to control the amount of energy or heat generated within the furnace 102 that is used in the operation of the reheater section 108 of the boiler system of FIG. 1. Of course, the operation of the dampers provided by the balancer unit 170 controls the ratio or relative amounts of energy or heat provided to the reheater section 108 and the superheater sections 104 and 106, as diverting more flue gas to one section typically reduces the amount of flue gas provided to the other section. Still further, while the balancer unit 170 is illustrated in FIG. 3 as performing damper control, the balancer 170 can also provide control using furnace burner tilt position or in some cases, both.

Because of temporary or short term fluctuations in the steam temperature, and the fact that the operation of the balancer unit 170 is tied in with operation of the superheater sections 104 and 106 as well as the reheater section 108, the balancer unit 170 may not be able to provide complete control of the steam temperature 163 at the output of the reheater section 108, to assure that the desired steam temperature at this location 161 is attained. As a result, secondary control of the steam temperature 163 at the input of the turbine 118 is provided by the operation of the reheater spray section 112.

In particular, control of the reheater spray section 112 is provided by the operation of the spray setpoint unit 168 and a control block 180. Here, the spray setpoint unit 168 determines a reheater spray setpoint based on a number of factors, taking into account the operation of the balancer unit 170, in well known manners. Typically, however, the spray setpoint unit 168 is configured to operate the reheater spray section 112 only when the operation of the balancer unit 170 cannot provide enough or adequate control of the steam temperature 161 at the input of the turbine 118. In any event, the reheater spray setpoint is provided as a setpoint to the control block 180 (again illustrated as a PID control block) which compares this setpoint with a measurement of the actual steam temperature 161 at the output of the reheater section 108 and produces a control signal based on the difference between these two signals, and the control signal is used to control the reheater spray valve 124. As is known, the reheater spray valve 124 then operates to provide a controlled amount of reheater spray to perform further or additional control of the steam temperature at output of the reheater 108.

In some embodiments, the control of the reheater spray section 112 may be performed using a similar control scheme as discussed with respect to FIG. 2. For example, the use of a reheater section variable 162 as an input to the control loop 160 of FIG. 3 is not limited to a manipulated variable used to actually control the reheater section in a particular instance. Thus, it may be possible to use a reheater manipulated variable 162 that is not actually used to control the reheater section 108 as an input to the control loop 160, or some other control or disturbance variable of the boiler system 100.

Similar to the PID-based control loops 130 and 132 of FIG. 2, the PID-based control loop 160 is also reactionary. That is, the PID-based control loop 160 (or portions thereof) reacts to initiate a change only after a detected difference or error between a setpoint and an actual value is detected. For example, only after the control block 164 detects a difference between the reheater output steam temperature 163 and the desired setpoint generated by the control block 161 does the control block 164 produce a control signal to the summer 166, and only after the control block 180 detects a difference between the reheater output temperature 163 and the setpoint determined at the block 168 does the control block 180 produce a control signal to the spray valve 124. This reactionary control response coupled with changing boiler operating conditions can result in large output swings that may shorten the life of tubes, spray control valves, and other components of the system.

Figure 4:
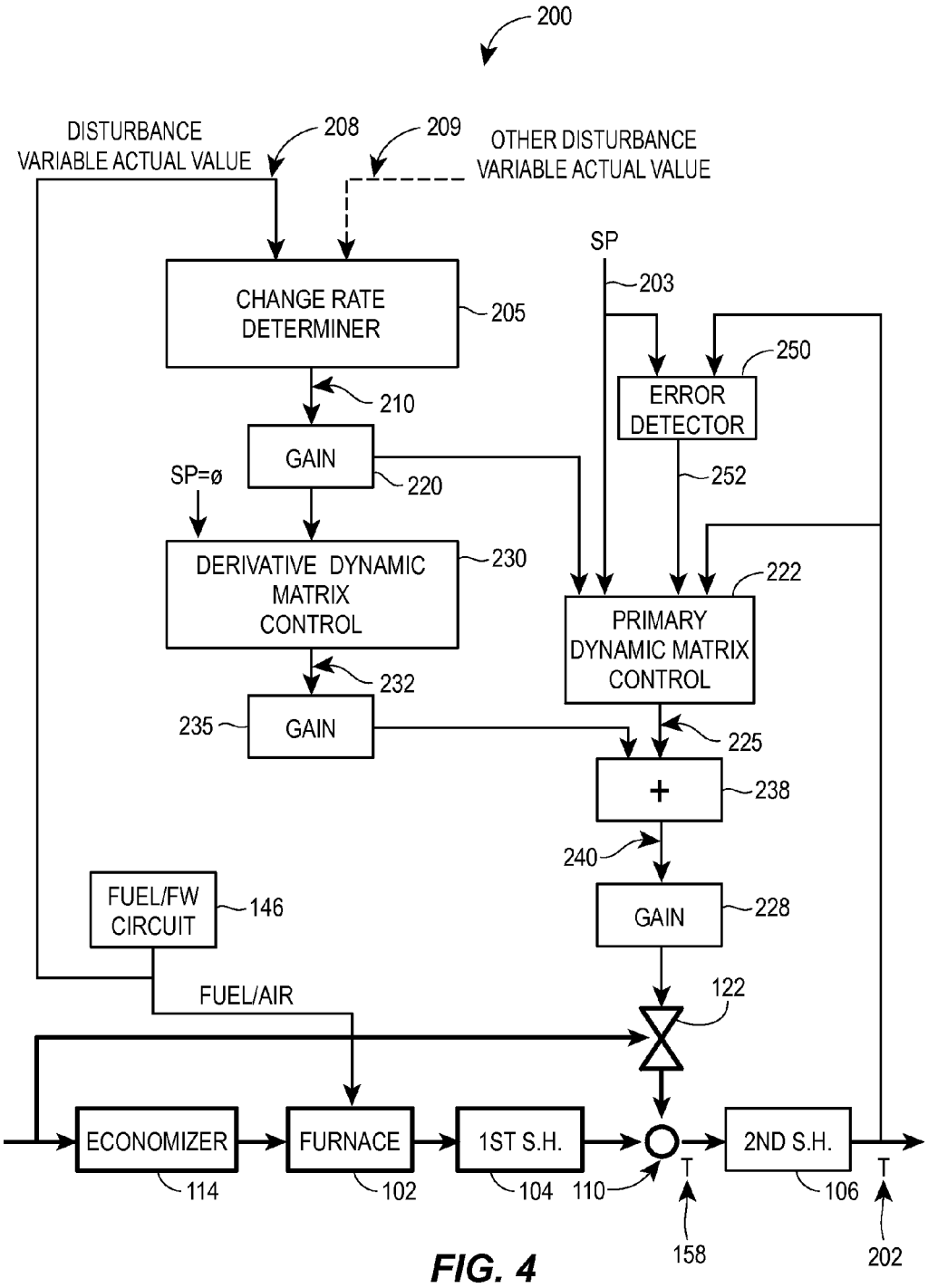
FIG. 4 illustrates a schematic diagram of a manner of controlling the boiler steam cycle of the steam powered turbines of FIG. 1 in a manner which helps to optimize efficiency of the system.

FIG. 4 illustrates an embodiment of a control system or control scheme 200 for controlling the steam generating boiler system 100. The control system 200 may control at least a portion of the boiler system 100 such as a control variable or other dependent process variable of the boiler system 100. In the example shown in FIG. 4, the control system 200 controls a temperature of output steam 202 delivered from the boiler system 100 to the turbine 116, but in other embodiments, the control scheme 200 may control another portion of the boiler system 100 (e.g., an intermediate portion such as a temperature of steam entering the second superheater section 106, or a system output, an output parameter, or an output control variable such as a pressure of the output steam at the turbine 118). The control system or control scheme 200 may be performed in or may be communicatively coupled with the controller or controller unit 120 of the boiler system 100. For example, in some embodiments, at least a portion of the control system or control scheme 200 may be included in the controller 120. In some embodiments, the entire control system or control scheme 200 may be included in the controller 120.

Indeed, the control system 200 of FIG. 4 may be a replacement for the PID-based control loops 130 and 132 of FIG. 2. However, instead of being reactionary like the control loops 130 and 132 (e.g., where a control adjustment is not initiated until after a difference or error is detected between the portion of the boiler system 100 that is desired to be controlled and a corresponding setpoint), the control scheme 200 is at least partially feed forward in nature, so that the control adjustment is initiated before a difference or error at the portion of the boiler system 100 is detected. Specifically, the control system or scheme 200 may be based on a rate of change of one or more disturbance variables that affect the portion of the boiler system 100 that is desired to be controlled. A dynamic matrix control (DMC) block may receive the rate of change of the one or more disturbance variables at an input and may cause the process to run at an optimal point based on the rate of change. Moreover, the DMC block may continually optimize the process over time as the rate of change itself changes. Thus, as the DMC block continually estimates the best response and predictively optimizes or adjusts the process based on current inputs, the dynamic matrix control block is feed forward or predictive in nature and is able to control the process more tightly around its setpoint. Accordingly, process components are not subjected to wide swings in temperature or other such factors with the DMC-based control scheme 200. In contrast, PID-based control systems or schemes cannot predict or estimate optimizations at all, as PID-based control systems or schemes require a resultant measurement or error in the controlled variable to actually occur in order to determine any process adjustments. Consequently, PID-based control systems or schemes swing more widely from desired setpoints than the control system or scheme 200, and process components in PID-based control systems typically fail earlier due to these extremes.

In further contrast to the PID-based control loops 130 and 132 of FIG. 2, the DMC-based control system or scheme 200 does not require receiving, as an input, any intermediate or upstream value corresponding to the portion of the boiler system 100 that is desired to be controlled, such as the intermediate steam temperature 158 determined after the spray valve 122 and before the second superheater section 106. Again, as the DMC-based control system or scheme 200 is at least partially predictive, the DMC-based control system or scheme 200 does not require intermediate "checkpoints" to attempt to optimize the process, as do PID-based schemes. These differences and details of the control system 200 are described in more detail below.

In particular, the control system or scheme 200 includes a change rate determiner 205 that receives a signal corresponding to a measure of an actual disturbance variable of the control scheme 200 that currently affects a desired operation of the boiler system 100 or a desired output value of a control or dependent process variable 202 of the control scheme 200, similar to the measure of the control or manipulated variable 131B received at the control block 140 of FIG. 2. In the embodiment illustrated in FIG. 4, the desired operation of the boiler system 100 or controlled variable of the control scheme 200 is the output steam temperature 202, and the disturbance variable input to the control scheme 200 at the change rate determiner 205 is a fuel to air ratio 208 being delivered to the furnace 102. However, the input to the change rate determiner 205 may be any disturbance variable. For example, the disturbance variable of the control scheme 200 may be a manipulated variable that is used in some other control loop of the boiler system 100 other than the control scheme 200, such as a damper position. The disturbance variable of the control scheme 200 may be a control variable that is used in some other control loop of the boiler system 100 other than the control scheme 200, such as intermediate temperature 126B of FIG. 1. The disturbance variable input into the change rate determiner 205 may be considered simultaneously as a control variable of another particular control loop, and a manipulated variable of yet another control loop in the boiler system 100, such as the fuel to air ratio. The disturbance variable may be some other disturbance variable of another control loop, e.g., ambient air pressure or some other process input variable. Examples of possible disturbance variables that may be used in conjunction with the DMC-based control system or scheme 200 include, but are not limited to a furnace burner tilt position; a steam flow; an amount of soot blowing; a damper position; a power setting; a fuel to air mixture ratio of the furnace; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel; a type of fuel, or some other manipulated variable, control variable, or disturbance variable. In some embodiments, the disturbance variable may be a combination of one or more control, manipulated, and/or disturbance variables.

In an embodiment, only one signal corresponding to a measure of one disturbance variable of the control system or scheme 200 is received at the change rate determiner 205, e.g., such as indicated by the solid arrow 208 in FIG. 4. In some embodiments, more than one signal corresponding to more than one disturbance variable of the control system or scheme 200 may be received by the change rate determiner 205, e.g., such as indicated by the solid arrow 208 and the dashed arrow 209. However, in contrast to reference 131A of FIG. 2, it is not necessary for the change rate determiner 205 to receive a setpoint or desired/optimal value corresponding to the measured disturbance variable, e.g., in FIG. 4, it is not necessary to receive a setpoint for the fuel to air ratio 208.

Figure 5:
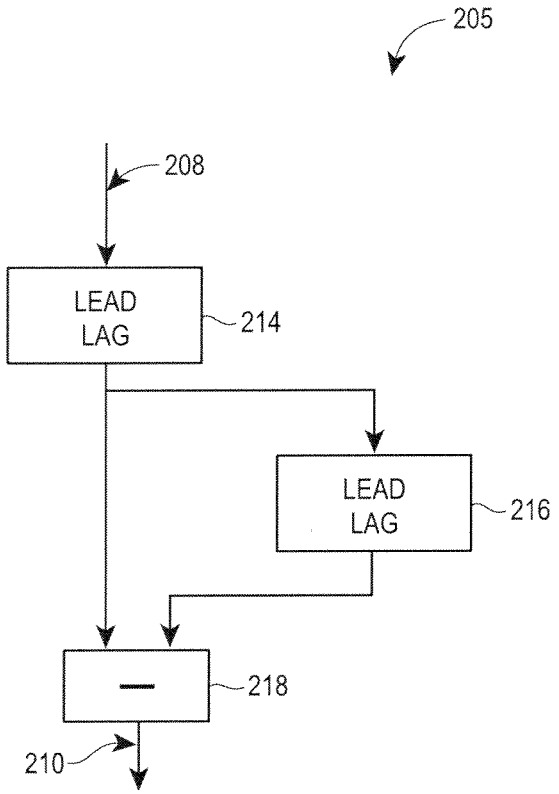
FIG. 5 illustrates an embodiment of the change rate determiner of FIG. 4.

The change rate determiner 205 is configured to determine a rate of change of the disturbance variable input 208 and to generate a signal 210 corresponding to the rate of change of the input 208. FIG. 5 illustrates an example of the change rate determiner 205. In this example, the change rate determiner 205 includes at least two lead lag blocks 214 and 216 that each adds an amount of time lead or time lag to the received input 208. Using the outputs of the two lead lag blocks 214 and 216, the change rate determiner 205 determines a difference between two measures of the signal 208 at two different points in time, and accordingly, determines a slope or a rate of change of the signal 208.

In particular, the signal 208 corresponding to the measure of the disturbance variable may be received at an input of the first lead lag block 214 that may add a time delay. An output generated by the first lead lag block 214 may be received at a first input of a difference block 218. The output of the first lead lag block 214 may also be received at an input of the second lead lag block 216 that may add an additional time delay that may be same as or different than the time delay added by the first lead lag block 214. The output of the second lead lag block 216 may be received at a second input of the difference block 218. The difference block 218 may determine a difference between the outputs of the lead lag blocks 214 and 216, and, by using the time delays of the lead lag blocks 214, 216, may determine the slope or the rate of change of the disturbance variable 208. The difference block 218 may generate a signal 210 corresponding to a rate of change of the disturbance variable 208. In some embodiments, one or both of the lead lag blocks 214, 216 may be adjustable to vary their respective time delay. For instance, for a disturbance input 208 that changes more slowly over time, a time delay at one or both lead lag blocks 214, 216 may be increased. In some embodiments, the change rate determiner 205 may collect more than two measures of the signal 208 in order to more accurately calculate the slope or rate of change. Of course, FIG. 5 is only one example of the change rate determiner 205 of FIG. 4, and other examples may be possible.

Turning back to FIG. 4, the signal 210 corresponding to the rate of change of the disturbance variable may be received by a gain block or a gain adjustor 220 that introduces gain to the signal 210. The gain may be amplificatory or the gain may be fractional. The amount of gain introduced by the gain block 220 may be manually or automatically selected. In some embodiments, the gain block 220 may be omitted.

The signal 210 corresponding to the rate of change of the disturbance variable of the control system or scheme 200 (including any desired gain introduced by the optional gain block 220) may be received at a dynamic matrix control (DMC) block 222. The DMC block 222 may also receive, as inputs, a measure of a current or actual value of the portion of the boiler system 100 to be controlled (e.g., the control or controlled variable of the control system or scheme 200; in the example of FIG. 4, the temperature 202 of the steam output) and a corresponding setpoint. The dynamic matrix control block 222 may perform model predictive control based on the received inputs to generate a control output signal. Note that unlike the PID-based control loops 130 and 132 of FIG. 2, the DMC block 222 does not need to receive any signals corresponding to intermediate measures of the portion of the boiler system 100 to be controlled, such as the intermediate steam temperature 158. However, such signals may be used as inputs to the DMC block 222 if desired, for instance, when a signal to an intermediate measure is input into the change rate determiner 205 and the change rate determiner 205 generates a signal corresponding to the rate of change of the intermediate measure. Furthermore, although not illustrated in FIG. 4, the DMC block 222 may also receive other inputs in addition to the signal 210 corresponding to the rate of change, the signal corresponding to an actual value of the controlled variable (e.g., reference 202), and its setpoint. For example, the DMC block 222 may receive signals corresponding to zero or more disturbance variables other than the signal 210 corresponding to the rate of change.

Generally speaking, the model predictive control performed by the DMC block 222 is a multiple-input-single-output (MISO) control strategy in which the effects of changing each of a number of process inputs on each of a number of process outputs is measured and these measured responses are then used to create a model of the process. In some cases, though, a multiple-input-multiple-output (MIMO) control strategy may be employed. Whether MISO or MIMO, the model of the process is inverted mathematically and is then used to control the process output or outputs based on changes made to the process inputs. In some cases, the process model includes or is developed from a process output response curve for each of the process inputs and these curves may be created based on a series of, for example, pseudo-random step changes delivered to each of the process inputs. These response curves can be used to model the process in known manners. Model predictive control is known in the art and, as a result, the specifics thereof will not be described herein. However, model predictive control is described generally in Qin, S. Joe and Thomas A. Badgwell, "An Overview of Industrial Model Predictive Control Technology," *AIChE Conference,* 1996.

Moreover, the generation and use of advanced control routines such as MPC control routines may be integrated into the configuration process for a controller for the steam generating boiler system. For example, Wojsznis et al., U.S. Pat. No. 6,445,963 entitled "Integrated Advanced Control Blocks in Process Control Systems," the disclosure of which is hereby expressly incorporated by reference herein, discloses a method of generating an advanced control block such as an advanced controller (e.g., an MPC controller or a neural network controller) using data collected from the process plant when configuring the process plant. More particularly, U.S. Pat. No. 6,445,963 discloses a configuration system that creates an advanced multiple-input-multiple-output control block within a process control system in a manner that is integrated with the creation of and downloading of other control blocks using a particular control paradigm, such as the Fieldbus paradigm. In this case, the advanced control block is initiated by creating a control block (such as the DMC block 222) having desired inputs and outputs to be connected to process outputs and inputs, respectively, for controlling a process such as a process used in a steam generating boiler system. The control block includes a data collection routine and a waveform generator associated therewith and may have control logic that is untuned or otherwise undeveloped because this logic is missing tuning parameters, matrix coefficients or other control parameters necessary to be implemented. The control block is placed within the process control system with the defined inputs and outputs communicatively coupled within the control system in the manner that these inputs and outputs would be connected if the advanced control block was being used to control the process. Next, during a test procedure, the control block systematically upsets each of the process inputs via the control block outputs using waveforms generated by the waveform generator specifically designed for use in developing a process model. Then, via the control block inputs, the control block coordinates the collection of data pertaining to the response of each of the process outputs to each of the generated waveforms delivered to each of the process inputs. This data may, for example, be sent to a data historian to be stored. After sufficient data has been collected for each of the process input/output pairs, a process modeling procedure is run in which one or more process models are generated from the collected data using, for example, any known or desired model generation or determination routine. As part of this model generation or determination routine, a model parameter determination routine may develop the model parameters, e.g., matrix coefficients, dead time, gain, time constants, etc. needed by the control logic to be used to control the process. The model generation routine or the process model creation software may generate different types of models, including non-parametric models, such as finite impulse response (FIR) models, and parametric models, such as autoregressive with external inputs (ARX) models. The control logic parameters and, if needed, the process model, are then downloaded to the control block to complete formation of the advanced control block so that the advanced control block, with the model parameters and/or the process model therein, can be used to control the process during run-time. When desired, the model stored in the control block may be redetermined, changed, or updated.

In the example illustrated by FIG. 4, the inputs to the dynamic matrix control block 222 include the signal 210 corresponding to the rate of change of the one or more disturbance variables of the control scheme 200 (such as one or more of the previously discussed disturbance variables), a signal corresponding to a measure of an actual value or level of the controlled output, and a setpoint corresponding to a desired or optimal value of the controlled output. Typically (but not necessarily), the setpoint is determined by a user or operator of the steam generating boiler system 100. The DMC block 222 may use a dynamic matrix control routine to predict an optimal response based on the inputs and a stored model (typically parametric, but in some cases may be non-parametric), and the DMC block 222 may generate, based on the optimal response, a control signal 225 for controlling a field device. Upon reception of the signal 225 generated by the DMC block 222, the field device may adjust its operation based on control signal 225 received from the DMC block 222 and influence the output towards the desired or optimal value. In this manner, the control scheme 200 may feed forward the rate of change 210 of one or more disturbance variables, and may provide advanced correction prior to any difference or error occurring in the output value or level. Furthermore, as the rate of change of the one or more disturbance variables 210 changes, the DMC block 222 predicts a subsequent optimal response based on the changed inputs 210 and generates a corresponding updated control signal 225.

In the example particularly illustrated in FIG. 4, the input to the change rate determiner 205 is a fuel to air ratio 208 being delivered to the furnace 102, the portion of the steam generating boiler system 100 that is controlled by the control scheme 200 is the output steam temperature 202, and the control scheme 200 controls the output steam temperature 202 by adjusting the spray valve 122. Accordingly, a dynamic matrix control routine of the DMC block 222 uses the signal 210 corresponding to the rate of change of the fuel to air ratio 208 generated by the change rate determiner 205, a signal corresponding to a measure of an actual output steam temperature 202, a desired output steam temperature or setpoint, and a parametric model to determine a control signal 225 for the spray valve 122. The parametric model used by the DMC block 222 may identify exact relationships between the input values and control of the spray valve 122 (rather than just a direction as in PID control). The DMC block 222 generates the control signal 225, and upon its reception, the spray valve 122 adjusts an amount of spray flow based on the control signal 225, thus influencing the output steam temperature 202 towards the desired temperature. In this feed forward manner, the control system 200 controls the spray valve 122, and consequently the output steam temperature 202 based on a rate of change of the fuel to air ratio 208. If the fuel to air ratio 208 subsequently changes, then the DMC block 222 may use the updated fuel to air ratio 208, the parametric model, and in some cases, previous input values, to determine a subsequent optimal response. A subsequent control signal 225 may be generated and sent to the spray valve 122.

The control signal 225 generated by the DMC block 222 may be received by a gain block or gain adjustor 228 (e.g., a summer gain adjustor) that introduces gain to the control signal 225 prior to its delivery to the field device 122. In some cases, the gain may be amplificatory. In some cases, the gain may be fractional. The amount of gain introduced by the gain block 228 may be manually or automatically selected. In some embodiments, the gain block 228 may be omitted.

Steam generating boiler systems by their nature, however, generally respond somewhat slowly to control, in part due to the large volumes of water and steam that move through the system. To help shorten the response time, the control scheme 200 may include a derivative dynamic matrix control (DMC) block 230 in addition to the primary dynamic matrix control block 222. The derivative DMC block 230 may use a stored model (either parametric or a non-parametric) and a derivative dynamic matrix control routine to determine an amount of boost by which to amplify or modify the control signal 225 based on the rate of change or derivative of the disturbance variable received at an input of the derivative DMC block 230. In some cases, the control signal 225 may also be based on a desired weighting of the disturbance variable, and/or the rate of change thereof. For example, a particular disturbance variable may be more heavily weighted so as to have more influence on the controlled output (e.g., on the reference 202). Typically, the model stored in the derivative DMC block 230 (e.g., the derivative model) may be different than the model stored in the primary DMC block 222 (e.g., the primary model), as the DMC blocks 222 and 230 each receive a different set of inputs to generate different outputs. The derivative DMC block 230 may generate at its output a boost signal or a derivative signal 232 corresponding to the amount of boost.

A summer block 238 may receive the boost signal 232 generated by the derivative DMC block 230 (including any desired gain introduced by the optional gain block 235) and the control signal 225 generated by the primary DMC block 222. The summer block 238 may combine the control signal 225 and the boost signal 232 to generate a summer output control signal 240 to control a field device, such as the spray valve 122. For example, the summer block 238 may add the two input signals 225 and 232, or may amplify the control signal 225 by the boost signal 232 in some other manner. The summer output control signal 240 may be delivered to the field device to control the field device. In some embodiments, optional gain may be introduced to the summer output control signal 240 by the gain block 228, in a manner such as previously discussed for the gain block 228.

Upon reception of the summer output control signal 240, a field device such as the spray valve 122 may be controlled so that the response time of the boiler system 100 is shorter than a response time when the field device is controlled by the control signal 225 alone so as to move the portion of the boiler system that is desired to be controlled more quickly to the desired operating value or level. For example, if the rate of change of the disturbance variable is slower, the boiler system 100 can afford more time to respond to the change, and the derivative DMC block 230 would generate a boost signal corresponding to a lower boost to be combined with the control output of the primary DMC block 230. If the rate of change is faster, the boiler system 100 would have to respond more quickly and the derivative DMC block 230 would generate a boost signal corresponding to a larger boost to be combined with the control output of the primary DMC block 230.

In the example illustrated by FIG. 4, the derivative DMC block 230 may receive, from the change rate determiner 205, the signal 210 corresponding to the rate of change of the fuel to air ratio 208, including, any desired gain introduced by the optional gain block 220. Based on the signal 210 and a parametric model stored in the derivative DMC block 230, the derivative DMC block 230 may determine (via, for example, a derivative dynamic matrix control routine) an amount of boost that is to be combined with the control signal 225 generated by the primary DMC block 222, and may generate a corresponding boost signal 232. The boost signal 232 generated by the derivative DMC block 230 may be received by a gain block or gain (e.g., a derivative or boost gain adjustor) 235 that introduces gain to the boost signal 232. The gain may be amplificatory or fractional, and an amount of gain introduced by the gain block 235 may be manually or automatically selected. In some embodiments, the gain block 235 may be omitted.

Although not illustrated, various embodiments of the control system or scheme 200 are possible. For example, the derivative DMC block 230, its corresponding gain block 235, and the summer block 238 may be optional. In particular, in some faster responding systems, the derivative DMC block 230, the gain block 235 and the summer block 238 may be omitted. In some embodiments, one or all of the gain blocks 220, 228 and 235 may be omitted. In some embodiments, a single change rate determiner 205 may receive one or more signals corresponding to multiple disturbance variables, and may deliver a single signal 210 corresponding to rate(s) of change to the primary DMC block 222. In some embodiments, multiple change rate determiners 205 may each receive one or more signals corresponding to different disturbance variables, and the primary DMC block 222 may receive multiple signals 210 from the multiple change rate determiners 205. In the embodiments including multiple change rate determiners 205, each of the multiple change rate determiners 205 may be in connection with a different corresponding derivative DMC block 230, and the multiple derivative DMC blocks 230 may each provide their respective boost signals 232 to the summer block 238. In some embodiments, the multiple change rate determiners 205 may each provide their respective boost outputs 210 to a single derivative DMC block 230. Of course, other embodiments of the control system 200 may be possible.

Furthermore, as the steam generating boiler system 100 generally includes multiple field devices, embodiments of the control system or scheme 200 may support the multiple field devices. For example, a different control system 200 may correspond to each of the multiple field devices, so that each different field device may be controlled by a different change rate determiner 205, a different primary DMC block 222, and a different (optional) derivative DMC block 230. That is, multiple instances of the control system 200 may be included in the boiler system 100, with each of the multiple instances corresponding to a different field device. In some embodiments of the boiler system 100, at least a portion of the control scheme 200 may service multiple field devices. For example, a single change rate determiner 205 may service multiple field devices, such as multiple spray valves. In an illustrative scenario, if more than one spray valve is desired to be controlled based on the rate of change of fuel to air ratio, a single change rate determiner 205 may generate a signal 210 corresponding to the rate of change of fuel to air ratio and may deliver the signal 210 to different primary DMC blocks 222 corresponding to the different spray valves. In another example, a single primary DMC block 222 may control all spray valves in a portion of or the entire boiler system 100. In other examples, a single derivative DMC block 230 may deliver a boost signal 232 to multiple primary DMC blocks 222, where each of the multiple primary DMC blocks 222 provides its generated control signal 225 to a different field device. Of course, other embodiments of the control system or scheme 200 to control multiple field devices may be possible.

Figure 6:
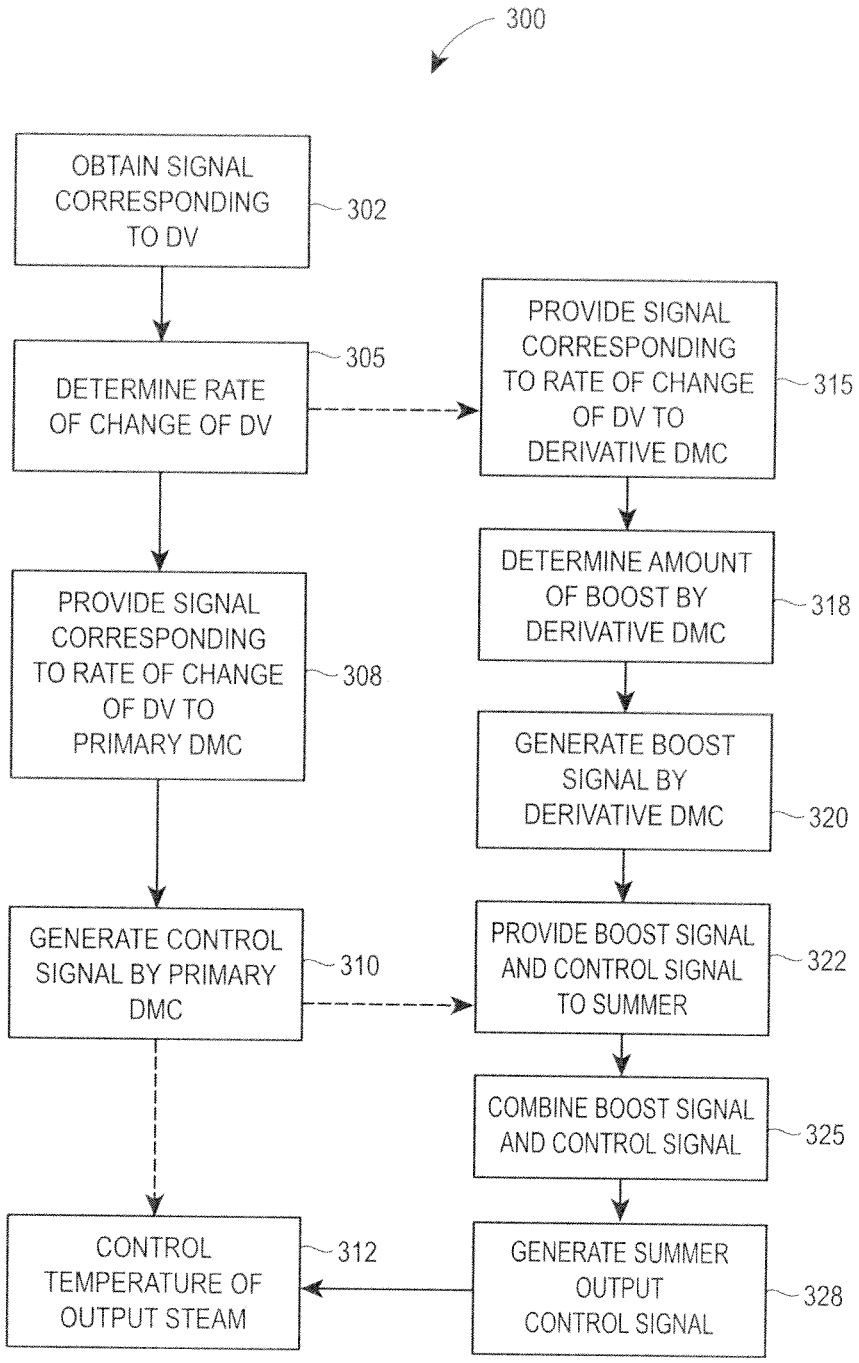
FIG. 6 illustrates an exemplary method of controlling a steam generating boiler system.

FIG. 6 illustrates an exemplary method 300 of controlling a steam generating boiler system, such as the steam generating boiler system 100 of FIG. 1. The method 300 may also operate in conjunction with embodiments of the control system or control scheme 200 of FIG. 4. For example, the method 300 may be performed by the control system 200 or the controller 120. For clarity, the method 300 is described below with simultaneous referral to the boiler 100 of FIG. 1 and to the control system or scheme 200 of FIG. 4.

At block 302, a signal 208 indicative of a disturbance variable used in the steam generating boiler system 100 may be obtained or received. The disturbance variable may be any control, manipulated or disturbance variable used in the boiler system 100, such as a furnace burner tilt position; a steam flow; an amount of soot blowing; a damper position; a power setting; a fuel to air mixture ratio of the furnace; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel; or a type of fuel. In some embodiments, more than one signal 208, 209 may correspond to more than one disturbance variable. At block 305, a rate of change of the disturbance variable may be determined. At block 308, a signal 210 indicative of the rate of change of the disturbance variable may be generated and provided to an input of a dynamic matrix controller, such as the primary DMC block 222. In some embodiments, the blocks 302, 305 and 308 may be performed by the change rate determiner 205.

At block 310, a control signal 225 corresponding to an optimal response may be generated based on the signal 210 indicative of the rate of change of the disturbance variable generated at the block 308. For example, the control signal 225 may be generated by the primary DMC block 222 based on the signal 210 indicative of the rate of change of the disturbance variable and a parametric model corresponding to the primary DMC block 222. At block 312, a temperature 202 of output steam generated by the steam generating boiler system 100 immediately prior to delivery to a turbine 116 or 118 may be controlled based on the control signal 225 generated by the block 310.

In some embodiments, the method 300 may include additional blocks 315-328. In these embodiments, at the block 315, the signal 210 corresponding to the rate of change of the disturbance variable determined by the block 305 may also be provided to a derivative dynamic matrix controller, such as the derivative DMC block 230 of FIG. 4. At the block 318, an amount of boost may be determined based on the rate of change of the disturbance variable, and at the block 320, a boost signal or a derivative signal 232 corresponding to the amount of boost determined at the block 318 may be generated.

At the block 322, the boost or derivative signal 232 generated at the block 320 and the control signal 225 generated at the block 310 may be provided to a summer, such as the summer block 238 of FIG. 4. At the block 325, the boost or derivative signal 232 and the control signal 225 may be combined. For example, the boost signal 232 and the control signal 225 may be summed, or they may be combined in some other manner. At the block 328, a summer output control signal may be generated based on the combination, and at the block 312, the temperature of the output steam may be controlled based on the summer output control signal. In some embodiments, the block 312 may include providing the control signal 225 to a field device in the boiler system 100 and controlling the field device based on the control signal 225 so that the temperature 202 of the output steam is, in turn, controlled. Note that for embodiments of the method 300 that include the blocks 315-328, the flow from the block 310 to the block 312 is omitted and the method 300 may flow instead from the block 310 to the block 322, as indicated by the dashed arrows.

Still further, the control schemes, systems and methods described herein are each applicable to steam generating systems that use other types of configurations for superheater and reheater sections than illustrated or described herein. Thus, while FIGS. 1-4 illustrate two superheater sections and one reheater section, the control scheme described herein may be used with boiler systems having more or less superheater sections and reheater sections, and which use any other type of configuration within each of the superheater and reheater sections.

Moreover, the control schemes, systems and methods described herein are not limited to controlling only an output steam temperature of a steam generating boiler system. Other dependent process variables of the steam generating boiler system may additionally or alternatively be controlled by any of the control schemes, systems and methods described herein. For example, the control schemes, systems and methods described herein are each applicable to controlling an amount of ammonia for nitrogen oxide reduction, drum levels, furnace pressure, throttle pressure, and other dependent process variables of the steam generating boiler system.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of maintaining an output steam temperature of a steam generating boiler system at a desired output steam temperature setpoint, comprising:

obtaining a signal indicative of a disturbance variable used in a control loop of the steam generating boiler system operating to maintain a temperature of output steam at the desired output steam temperature setpoint, the signal indicative of the disturbance variable generated by a device included in a second portion of the steam generating boiler system, the portion of the steam generating boiler system excluding any devices included in the control loop;

determining a rate of change of the disturbance variable:

providing a signal indicative of the rate of change of the disturbance variable to an input of a dynamic matrix controller;

generating, by the dynamic matrix controller while the control loop of the steam generating boiler system is operating to maintain the temperature of the output steam at the desired output steam temperature setpoint, a control signal for a manipulated variable used in the control loop of the steam generating boiler system, the generating of the control signal for the manipulated variable based on the signal indicative of the rate of change of the disturbance variable and a signal indicative of the desired output steam temperature setpoint; and controlling, based on the control signal for the manipulated variable, the temperature of the output steam to be maintained at the desired output steam temperature setpoint, wherein the output steam is generated by the control loop of the steam generating boiler system for delivery to a turbine.

2. The method of claim 1, wherein the device is a field device of the steam generating boiler system.

3. The method of claim 2, wherein the field device corresponds to one of a plurality of sections of the steam generating boiler system, the plurality of sections including a furnace, a superheater section and a reheater section.

4. The method of claim 1, wherein obtaining the signal indicative of the disturbance variable includes obtaining a signal corresponding to at least one of: a furnace burner tilt position; a steam flow; an amount of soot blowing; a damper position; a power setting; a fuel to air mixture ratio of a furnace of the steam generating boiler system; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel;

a type of fuel, a manipulated variable of the portion of the steam generating boiler system, or a control variable of the portion of the steam generating boiler system.

5. The method of claim 1, wherein obtaining the signal indicative of the disturbance variable includes obtaining multiple different signals, with each of the multiple different signals corresponding to a different disturbance variable.

6. The method of claim 1, wherein generating the control signal comprises generating the control signal further based on a parametric model stored in the dynamic matrix controller.

7. The method of claim 1, wherein the dynamic matrix controller is a first dynamic matrix controller, and the method further comprises:

providing the signal indicative of the rate of change of the disturbance variable to an input of a second dynamic matrix controller;

determining an amount of boost to be added to the control signal; and generating, by the second dynamic matrix controller, a derivative signal corresponding to the amount of boost based on the rate of change of the disturbance variable; and wherein controlling the temperature of the output steam based on the control signal for the manipulated variable comprises controlling the temperature of the output steam based on a combination of the derivative signal generated by the second dynamic matrix controller and the control signal for the manipulated variable generated by the first dynamic matrix controller.

8. The method of claim 7, wherein:

generating the control signal by the first dynamic matrix controller comprises generating the control signal further based on a first parametric model stored in the first dynamic matrix controller, generating the derivative signal by the second dynamic matrix controller comprises generating the derivative signal further based on a derivative parametric model stored in the second dynamic matrix controller, and the first parametric model and the derivative parametric model are different parametric models.

9. The method of claim 1, wherein the input of the dynamic matrix controller is a first input, and the method further comprises providing a signal indicative of an actual temperature of the output steam to a second input of the dynamic matrix controller and providing the output steam temperature setpoint to a third input of the dynamic matrix controller; and wherein generating the control signal comprises generating the control signal based on the signal indicative of the rate of change of the disturbance variable provided at the first input, the signal indicative of the actual temperature of the output steam provided at the second input, and the output steam temperature setpoint provided at the third input.

10. The method of claim 1, wherein determining the rate of change of the disturbance variable comprises:

adding a first time delay to the signal indicative of the disturbance variable to generate a first delayed signal indicative of the disturbance variable;

adding an additional time delay to the first delayed signal to generate a second delayed signal indicative of the disturbance variable; and using the first delayed signal, the second delayed signal, the first time delay, and the second time delay to determine the rate of change of the disturbance variable.

11. The method of claim 10, further comprising adjusting the at least one of the first time delay or the second time delay.

12. The method of claim 11, wherein adjusting the at least one of the first time delay or the second time delay comprises adjusting the at least one of the first time delay or the second time delay based on the rate of change of the disturbance variable.

13. The method of claim 10, wherein using the first delayed signal, the second delayed signal, the first time delay, and the second time delay to determine the rate of change of the disturbance variable comprises determining a difference between the first delayed signal and the second delayed signal, and using the determined difference to determine the rate of change of the disturbance variable.

* * * * *